US006319182B1

(12) United States Patent
Schneider

(10) Patent No.: US 6,319,182 B1
(45) Date of Patent: Nov. 20, 2001

(54) METHOD OF AND APPARATUS FOR POSITIONING OF DEVICES ALONG A BAG-MAKING LINE

(75) Inventor: Jakob Schneider, Niederkassel (DE)

(73) Assignee: Lemo Maschinenbau GmbH, Niederkassel-Mondorf (DE)

( * ) Notice: Subject to any disclaimer, the term of this patent is extended or adjusted under 35 U.S.C. 154(b) by 0 days.

(21) Appl. No.: 09/441,776

(22) Filed: Nov. 17, 1999

(30) Foreign Application Priority Data

Dec. 9, 1998 (DE) ..... 198 56 648

(51) Int. Cl.[7] ..... B31B 1/00

(52) U.S. Cl. ..... 493/10; 493/8; 493/13; 493/25; 493/34

(58) Field of Search ..... 493/10, 8, 13, 493/14, 15, 17, 22, 24, 25, 34, 193

(56) References Cited

U.S. PATENT DOCUMENTS 2,321,647 * 6/1943 Brougham et al. ..... 493/24
4,604,083 * 8/1986 Barny et al. ..... 493/28
5,041,070 * 8/1991 Blaser ..... 493/14
5,470,300 * 11/1995 Terranova ..... 493/24
5,733,236 3/1998 De Smedt .
6,139,479 * 10/2000 Heiliger ..... 493/22
6,149,565 * 11/2000 Meyer et al. ..... 493/22

* cited by examiner

*Primary Examiner*—Peter Vo
*Assistant Examiner*—Sam Tawfik
(74) *Attorney, Agent, or Firm*—Herbert Dubno

(57) ABSTRACT

Devices used in making bags or otherwise carrying out operations on a web of material, such as a plastic web are repositioned based upon a measure of the repeat length of the intermittent advance of the web and comparison of the actual value of that advance with a setpoint value and in accordance with the product of the resulting error and the position of the device along the path of the web. The repositioning can use a positive coupling between a motor on the device and the path either via a rack and pinion for a spindle and nut.

11 Claims, 3 Drawing Sheets

METHOD OF AND APPARATUS FOR POSITIONING OF DEVICES ALONG A BAG-MAKING LINE

FIELD OF THE INVENTION

My present invention relates to a method of and to an apparatus for positioning of a plurality of devices used in the fabrication of plastic bags or line articles from a web of material such as a synthetic resin or plastic foil, along the path of the web which can be intermittently moved so that a portion of the web for making a particular article is advanced from device to device.

The invention has general application to the positioning of manufacturing devices for performing respective operations along any web of any material but is particularly applicable to bag-making machines in which the devices perform the successive operations on a plastic web which are required to fabricate bags from the plastic foil.

BACKGROUND OF THE INVENTION

In the production of bags from a synthetic resin foil web, apart from welding devices, which can be used to separate the bags from the web and simultaneously form lateral seams on the bag which are produced, frequently other devices must be provided along the path of the web to form various seams, produce various cutouts, incise openings, or to otherwise modify the shape or character of the bag which is ultimately to be separated from the web.

Typical among such devices are the devices for forming corner welds or gussets, devices for punching or incising ventilation holes and/or hanger holes, and the like. These additional devices are spaced apart by a distance equal to the increment of advance of the web or a multiple thereof and perform their respective operations in registry with the article to be produced at each location so that the openings and seams are all properly positioned in the finished bag when it is finally separated from the web. The increment of advance of the web is usually equal to the distance corresponding to a width of the bag or between successive separation seams. That distance is also referred to as a repetition length.

However, the mounting of a plurality of devices which perform independent operations on the web on a common carriage cannot solve the problem since each device must always be exactly positioned and for the most part, with the system described, only the one device which is in the immediate vicinity of the photocell may be positioned with sufficient accuracy. In the past, therefore, one had to be satisfied with a certain degree of imprecision with respect to the other devices of the bag-making line.

OBJECTS OF THE INVENTION

It is, therefore, the principal object of the present invention to provide a method of positioning individual devices of a bag-making line or other devices operating on a web which is intermittently disclosed for such operations, whereby rapid and exact repositioning of the devices is possible for all of the devices which must perform operations in registry with one another on successive regions of the web.

It is also an object of the invention to provide an improved apparatus of the type described with the ability to accurately reposition or newly position working devices in the event of a change in the repetition length over the course of operation.

Still another object of this invention is to provide a method of and an apparatus for making plastic bags whereby drawbacks of earlier bag-making machines, especially with respect to registry of successive bag-making operations, has proved to be a problem heretofore.

It is also an object of the invention to provide for improved control and positioning of welding, punching, incising or other shaping devices in a bag-making line so as to avoid drawbacks of earlier systems.

SUMMARY OF THE INVENTION

These objects are achieved, in accordance with the invention, by automatically positioning each of the devices in its correct position in the intermediate displacement region of the path of the web upon a change in the intermediate advance and in an automatic manner. This is achieved, in accordance with the invention by providing a sensor, e.g. a photocell, for determining deviations of the actual advance of the web from a setpoint advance and utilizing a computer or comparator, generating a correction value which is applied to each of the individual devices, as multiplied by a factor representing the distance of that device from a reference point, e.g. the point at which a seaming device is selected to weld a bag seam and separate the bag from the web, and then automatically to shift the particular device in accordance with the product of that factor and the correction value.

More particularly, the method of positioning a plurality of devices for carrying out successive operations upon the web of material comprises the steps of:

(a) a plurality of the devices along a stretch of a path of the web for effecting respective operations on the web in succession;

(b) intermittently advancing the web along the stretch;

(c) detecting changes in the intermittent advance of the web; and (d) repositioning the devices automatically along the path in response to a detected change in the advance of the web.

Preferably the web of material is a synthetic resin foil web for the making of bags and the devices are welding and punching devices for producing the bags, the web being intermittently advanced in increments corresponding to a dimension of a bag to be produced and the devices are positioned along the path at locations spaced by the dimension or a multiple thereof.

The method can further comprise the steps of:

comparing an actual value of an intermittent advance of the web with a setpoint value thereof;

computer-generating a correction value upon deviation of the compared actual value and setpoint value;

multiplying the correction value by a respective magnitude representing a distance of a respective one of the devices from a fixed reference point of the path to obtain a respective correction product; and repositioning each of the devices from a previous position by the respective correction product depending upon the distance of the respective device from the fixed reference point.

Advantageously, the sensor includes a photocell and at least one of the devices is configured to form seams between respective bags and at least one of the devices is configured to punch holes in the web.

The apparatus in its broadest terms can comprise:

a plurality of the devices positioned at respective locations along a stretch of a path of the web for effecting respective operations on the web in succession means for intermittently moving the web along the path past the devices;

means for detecting changes in the intermittent advance of the web; and means for repositioning the devices automatically along the path in response to a detected change in the advance of the web.

The device can have a respective drive for shifting it along the path and that drive can include an electric motor and a displacement-measuring transducer. The positive coupling between the drive and the path can be a pinion driven by the motor and engageable with a rack positioned along the path or a threaded spindle driven by the motor and engaging a nut positioned along the path.

BRIEF DESCRIPTION OF THE DRAWING

The above and other objects, features, and advantages will become more readily apparent from the following description, reference being made to the accompanying drawing in which.

SPECIFIC DESCRIPTION

Figure 1:
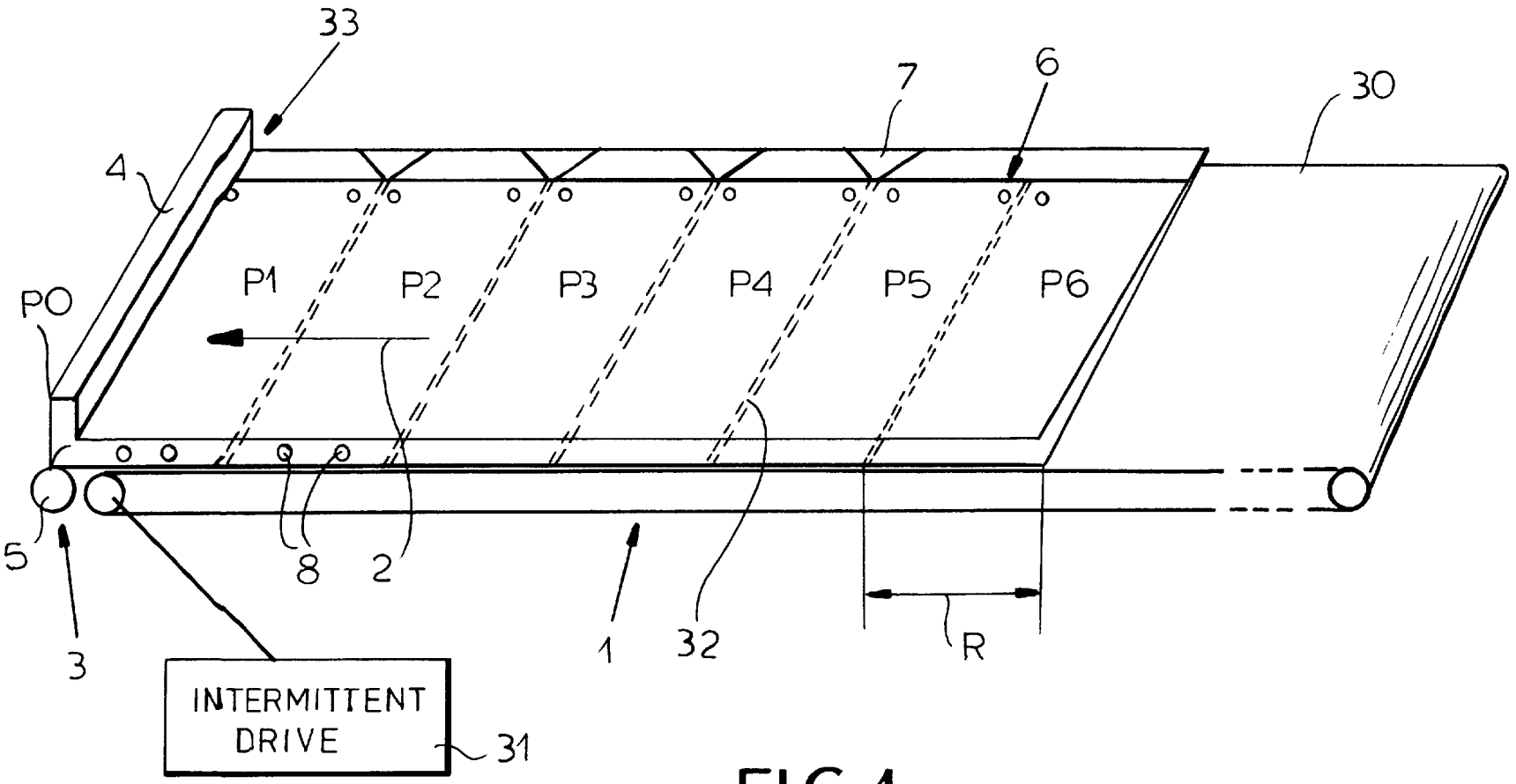
FIG. 1 is a diagrammatic perspective view showing successive positions of a synthetic resin foil workpiece and diagrammatically indicating the successive operations.

FIG. 1 shows a web 1 of a material, especially a synthetic resin foil, which can be fabricated into bags and which is advanced in the direction of arrow 2, e.g. from right to left, by an intermittent drive system, here represented as a belt conveyor 30 and an intermittent drive 31 for that belt conveyor. The web 1 is thus displaced intermittently at least in the region of interest with a repeat length R which corresponds to the width of a bag to be produced. The bags ultimately will be subdivided at weld seams which are formed by weld beam 4 and a welding roller 5 simultaneously with separation of the bag from the web, but at locations shown at the double-broken lines 32 in FIG. 1. The welding unit 4, 5 constitutes the first device 33 of a number of devices of the bag-making machine performing operations on the web to produce the bag. Other devices can be located at the positions P1, P2, P3, P4, P5 and P6 or at some of them as will be described hereinafter, the 0 position or reference point being the position P0 shown in FIG. 1. The other devices are thus located at various distances from the reference point P0 which are multiples of the repeat length R which corresponds to the increment by which the web is advanced.

For example, at the location P6, the device can form ventilating holes 6 in the web for the corresponding bag to be formed at that position while at the position P5, a corner weld 7 can be formed to define a gusset or the like at the bottom of the bag. At positions P3 and P4 other operations can be carried out, e.g. to form handles or ties and at a position P2 hanging openings 8 can be formed to enable the bags, once they are produced, to be padded or stacked and the resulting stack of bags suspended from a dispensing frame or support via the hanging openings 8.

Figure 2:
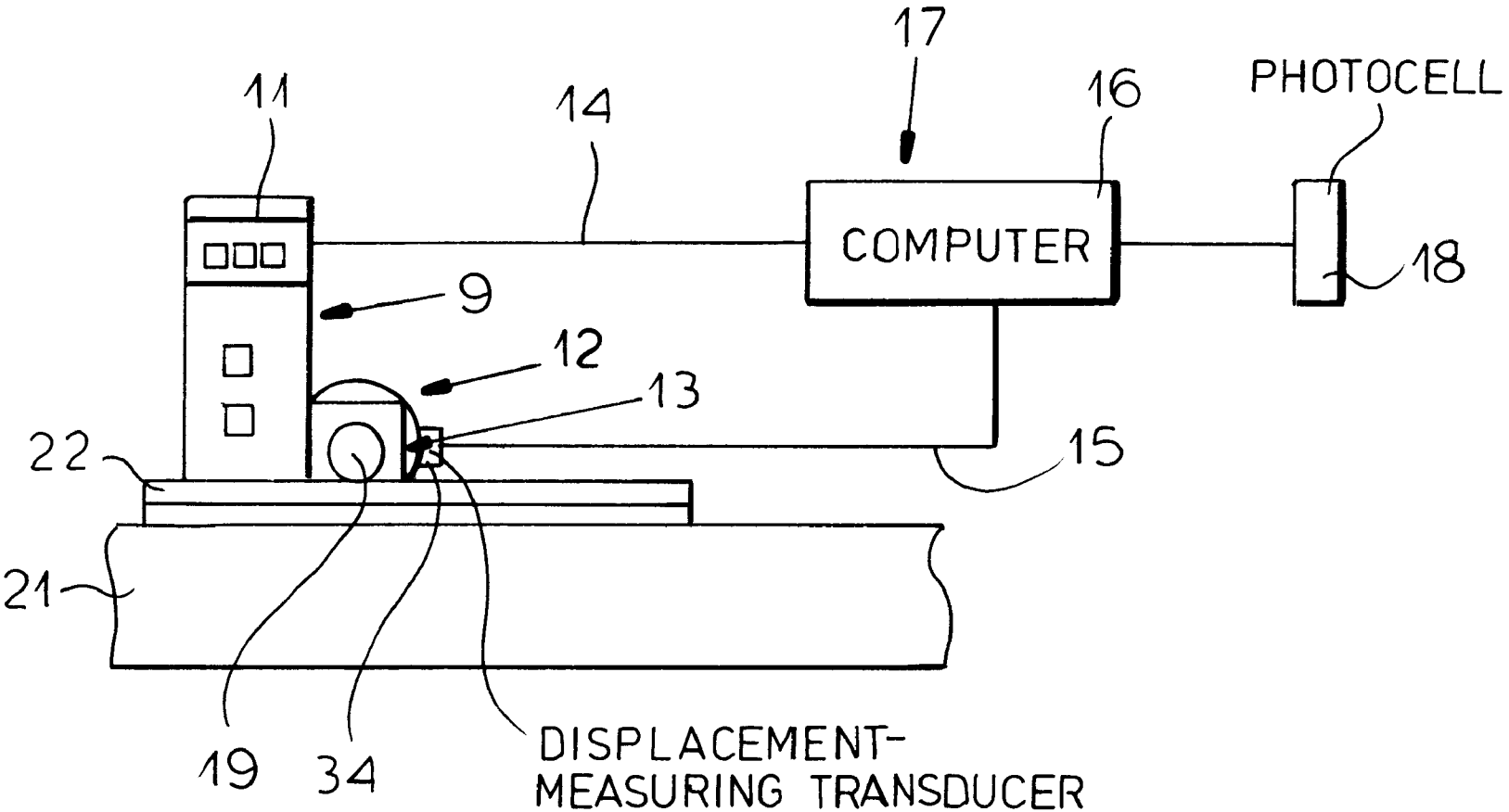
FIG. 2 is an elevational view showing part of the apparatus of the invention.

As can be seen from FIG. 2, each of the devices with the exception of the device at the reference point P0 can, as shown at 9, be provided with a control unit 11 having pushbuttons, keys or some other input device, enabling the location of the device to be inputted and permitting the device to dialogue with the computer 16 via the bus 14. The device 9 can be equipped with whatever tooling is necessary to perform the operation on the web required for that position P1 . . . P6.

Each of these devices has a drive unit 12 which can comprise a motor 13 and a displacement measuring transducer 34 which can have a feed-back connection 15 to the computer which, together with the displacement transducer and a photo cell 18 monitoring the position of the web, can form a control unit for which the photo cell 18 represents a sensor inputting the increment of advance of the web 1.

A pinion 19 of the motor 13 meshes with a rack 22 on the machine frame 21 extending along the length of the web 1 and in the direction of displacement 2 thereof.

Utilizing this control unit 17, therefore, the entire device 9 can be repositioned. For example, the devices 9 may be positioned accurately for a 300 mm value of R so that the spacing between positions P1 to P6 is 300 mm and the successive devices are at 300 mm centers. If, during production, the repeat length R changes from, for example, 300 mm to 302 mm because of the web tension stresses, each of the devices positioned at 300 mm centers upstream from the reference point P0 will be inaccurately positioned. Each device must be adjusted by the difference or error 2 mm starting from the 0 position and in accordance with the product between the respective position number and 2 mm. In position P4, therefore, the error of 8 mm is the requisite repositioning displacement of the device 9 at this position.

Figure 3:
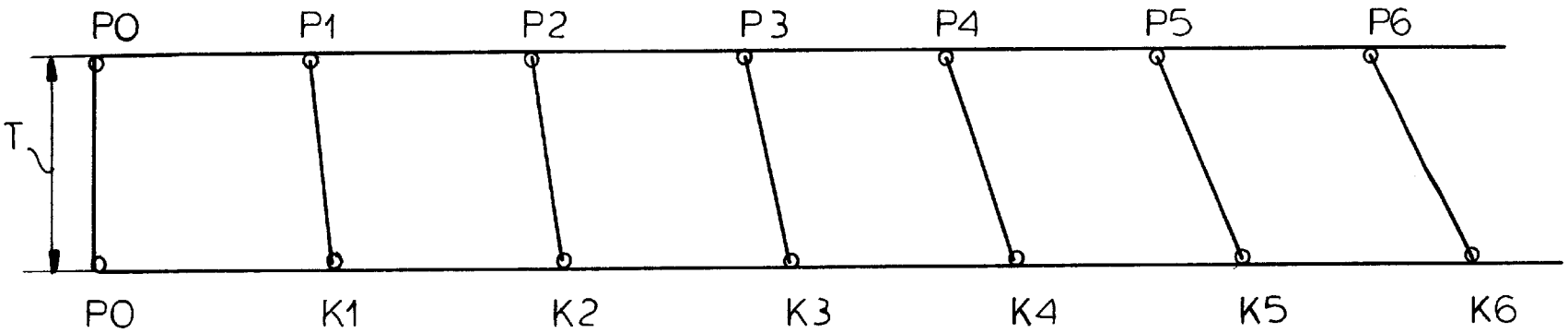
FIG. 3 is a graphic illustration of the repositioning of the devices.
Figure 4:
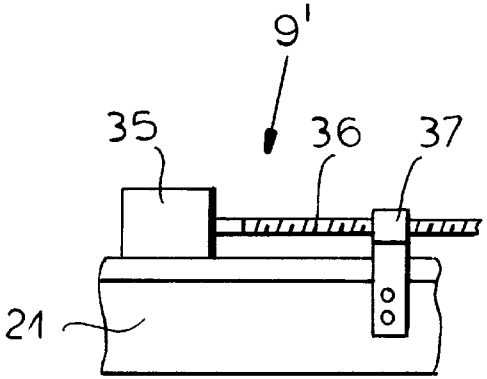
FIG. 4 is a fragmentary view similar to FIG. 2 but with another positive displacement mechanism.

The photo cell thus detects the actual value of the displacement of the web and that is compared in the computer 16 with the setpoint value. The difference is multiplied in the computer and the device shifted to the respective corrected position K1 . . . K6 as has been shown in FIG. 3. In FIG. 4 the motor 35 of the device drives a threaded spindle 36 rather than a pinion 19 and the threaded spindle is engaged in a nut 37 connected to the machine frame 21 previously described. The spindle thus shifts longitudinally with the device 9', of which it is part and which corresponds to the device 9 previously described.

I claim:

1. A method of positioning a plurality of welding and punching devices for producing bags by successive operations upon a synthetic resin foil web, comprising the steps of:

(a) positioning a plurality of said devices along a stretch of a path of said web for effecting respective operations on the web in succession;

(b) intermittently advancing said web along said stretch in increments corresponding to a dimension of a bag to be produced, said devices being positioned along said path at locations spaced by said dimension or a multiple of said dimension;

(c) detecting changes in movement in the intermittent advance of said web by a sensor;

(d) repositioning said devices automatically along said path in response to a detected change in the advance of said web;

(e) comparing an actual value of an intermittent advance of said web with a setpoint value thereof;

(f) computer-generating a correction value upon deviation of the compared actual value and setpoint value;

(g) multiplying the correction value by a respective magnitude representing a distance of a respective one of said devices from a fixed reference point of said path to obtain a respective correction product; and (h) repositioning each of said devices from a previous position by the respective correction product depending upon the distance of the respective device from the fixed reference point.

2. The method defined in claim 1 wherein said sensor includes a photocell and at least one of said devices is configured to form seams between respective bags and at least one of said devices is configured to punch holes in said web.

3. An apparatus for positioning a plurality of devices for carrying out successive operations upon a web of material, comprising:

a plurality of said devices positioned at respective locations along a stretch of a path of said web for effecting respective operations on the web in succession means for intermittently moving said web along said path past said devices;

means for detecting changes in movement in the intermittent advance of said web; and means for repositioning said devices automatically along said path in response to a detected change in the advance of said web, said web of material is a synthetic resin foil web for the making of bags and said devices are welding and punching devices for producing said bags, said web being intermittently advanced in increments corresponding to a dimension of a bag to be produced and said devices are positioned along said path at locations spaced by said dimension or a multiple of said dimension each of said devices being provided with a respective drive for shifting the respective device along said path, said changes in intermittent advance of said web being detected by a sensor responsive to movement of said web, said apparatus further comprising control means for:

comparing an actual value of an intermittent advance of said web with a setpoint value thereof;

computer-generating a correction value upon deviation of the compared actual value and setpoint value;

multiplying the correction value by a respective magnitude representing a distance of a respective one of said devices from a fixed reference point of said path to obtain a respective correction product; and repositioning each of said devices from a previous position by the respective correction product depending upon the distance of the respective device from the fixed reference point.

4. The apparatus defined in claim 3 wherein each of said drives includes an electric motor and a displacement-measuring transducer.

5. The apparatus defined in claim 4 wherein each of said drives includes a positive-displacement coupling between the respective motor and the path.

6. The apparatus defined in claim 5 wherein said positive-displacement coupling is a rack along said path and a pinion meshing with the rack and driven by said motor.

7. The apparatus defined in claim 5 wherein said positive-displacement coupling is a spindle extending along said path and driven by said motor.

8. The apparatus defined in claim 5 wherein said means for detecting is a sensor of web movement.

9. The apparatus defined in claim 8 wherein said sensor is a photocell.

10. The apparatus defined in claim 3 wherein a respective one of said devices at said reference point is a welding device.

11. The apparatus defined in claim 10 wherein each of said devices includes a controller for setting the respective position therein relative to said reference point.

* * * * *